US006409264B1

(12) United States Patent
Palmer et al.

(10) Patent No.: US 6,409,264 B1
(45) Date of Patent: Jun. 25, 2002

(54) INTERCHANGEABLE FURNITURE COVER SYSTEM

(76) Inventors: Johnnie Palmer, 830 C.R. 310, Tiplersville, MS (US) 38674; Joan Lewellen, 1108 City Ave., N., Ripley, MS (US) 38663

( * ) Notice: Subject to any disclaimer, the term of this patent is extended or adjusted under 35 U.S.C. 154(b) by 0 days.

(21) Appl. No.: 09/516,696

(22) Filed: Mar. 1, 2000

(51) Int. Cl.[7] ..... A47C 21/00; A47C 31/02

(52) U.S. Cl. ..... 297/218.3; 297/229; 297/225; 297/228.12

(58) Field of Search ..... 297/218.3, 228.12, 297/229, 218.5, 225

(56) References Cited

U.S. PATENT DOCUMENTS

| | | | | | |
|---|---|---|---|---|---|
| 3,311,408 | A | * | 3/1967 | Sarvas | 297/218.3 X |
| 3,563,599 | A | | 2/1971 | Heumann | |
| 3,695,690 | A | | 10/1972 | Carson | |
| 3,842,456 | A | | 10/1974 | Bronstein | 5/353.1 |
| 3,857,120 | A | | 12/1974 | Acker | 5/12 R |
| 3,858,256 | A | | 1/1975 | Beer | |
| 4,475,768 | A | | 10/1984 | Webb | |
| 4,478,453 | A | | 10/1984 | Schutz | |
| 4,838,610 | A | | 6/1989 | Perrin | 297/225 |
| 4,881,997 | A | | 11/1989 | Hatch | 156/66 |
| 5,005,901 | A | | 4/1991 | Hinde | |
| 5,028,472 | A | | 7/1991 | Gray | |
| 5,205,003 | A | | 4/1993 | Green | |
| 5,263,764 | A | * | 11/1993 | Laughlin et al. | 297/218.3 |
| 5,302,001 | A | | 4/1994 | van Dis | 297/228.13 |
| 5,329,654 | A | | 7/1994 | Sherman | 5/14 |
| 5,338,095 | A | | 8/1994 | Laughlin et al. | 297/440.1 |
| 5,540,480 | A | | 7/1996 | Christa | 297/219.1 |
| 5,711,169 | A | | 1/1998 | Leeke et al. | |
| 5,733,002 | A | | 3/1998 | Riely et al. | 297/224 |
| 5,738,414 | A | | 4/1998 | Wieland et al. | 297/440.1 |
| 5,768,754 | A | * | 6/1998 | Armstrong | 297/218.3 X |
| 5,826,939 | A | | 10/1998 | Beyer | 297/218.3 |
| 5,878,470 | A | | 3/1999 | Blansett | 29/91.1 |

* cited by examiner

*Primary Examiner*—Anthony D. Barfield
(74) *Attorney, Agent, or Firm*—Butler, Snow, O'Mara & Stevens & Cannada, PLLC

(57) ABSTRACT

A sofa or chair member, to support a human body, having a frame and an interchangeable upholstered cover is provided. The interchangeable upholstery cover for the sofa or chair, having an inner and outer surface. The inner surface having a first area shaped substantially like a seat and a second area with flaps projecting downwardly from the seat area, the inner surface having an attachment means on the seat area and on the flaps, and the outer surface being shaped substantially like an upholstered chair or sofa, the outer surface having a plurality of attachment means located at the bottom edge of the cover. A method of manufacture to make a modular upholstered frame and cover is provided.

6 Claims, 8 Drawing Sheets

INTERCHANGEABLE FURNITURE COVER SYSTEM

(4) CROSS-REFERENCE TO RELATED APPLICATIONS

Not applicable.

(5) STATEMENT REGARDING FEDERALLY SPONSORED RESEARCH AND DEVELOPMENT

Not applicable.

(6) REFERENCE TO A "MICROFICHE APPENDIX"

Not applicable.

(7) BACKGROUND OF THE INVENTION

1. Field of the Invention

The present invention relates to an interchangeable upholstered furniture cover and method to interchange upholstered furniture covers on frames.

2. Description of the Related Art

The use of Velcro™ in the field of furniture upholstery is known. More specifically, U.S. Pat. Nos. 3,695,690 and 5,878,470 show structures wherein the upholstery is secured to the furniture by Velcro means. In these patents the furniture cover attachment system adds only new fabric, while in the present invention the complete cover including the upholstered filler can be changed. This system provides a means to have a variety of upholstered looks, but with the reduced cost of only purchasing a frame and a few associated upholstered covers of various colors or shapes.

(8) BRIEF SUMMARY OF THE INVENTION

This invention provides a method to manufacture a seat member made of a frame and reversibly attachable cover. This method involves the steps of: constructing a frame made of: a base frame member, two arm frame members, a back frame member and a seat decking member. The base frame portion and the seat portion having means to reversibly attach the cover and the frame having upholstery padding attached to at least one of the members. The next step of this invention involves constructing a cover. The cover containing upholstery filler to form the shape of a seat member and having means to reversibly attach the frame.

This invention also provides a means of changing the look of a seat member by the steps of: constructing a frame. The frame having: a base frame member, two arm frame members, a back frame member and a seat-decking member. The base frame portion and the seat portion having means to reversibly attach the cover and having upholstery padding attached to at least one of the members. The next step involves constructing a first cover. The cover containing upholstery filler to form the shape of a seat member and having means to reversibly attach said frame. The nest step involves constructing a second cover. The second cover containing upholstery filler to form the shape of a seat member and having means to reversibly attach said frame. The next step involves attaching the first cover to the frame; detaching the first cover to said frame; and attaching the second cover to the frame. In this way a plain upholstered fabric can be changed to a patterned upholstered fabric without the need for reupholstery.

This invention also provides a seat member made of a frame and interchangeable cover. The frame is made of a base frame member, two arm frame members, a back frame member and a seat-decking member. The base frame portion and the seat portion have means to reversibly attach the cover. The frame having upholstery padding attached to at least one of the members. The seat member also includes a reversibly attachable cover. The cover being made of an inner and outer surface. The inner surface has a first area shaped substantially like a seat and a second area with flaps projecting downwardly from the seat area. The inner surface has an attachment means on the seat area and on the flaps. The outer surface forms the shape of a seat member. This seat member may be a sofa, love seat or chair. The outer surface has a plurality of attachment means located at the bottom inside edge of the cover and inner surface of the cover has a plurality of flaps with attachment means in reciprocal relationship with attachment means on the bottom surface of the frame. The inner surface of the cover further having an attachment means located in reciprocal relationship with the attachment means on the seat of the frame and the outer surface of the cover has a plurality of attachment means located on the bottom of the cover in a reciprocal relationship with attachment means on the bottom of the frame.

(9) BRIEF DESCRIPTION OF SEVERAL VIEWS OF THE DRAWING

A more complete understanding of the invention and its advantages will be apparent from the following Description of the Preferred Embodiment(s) taken in conjunction with the accompanying drawings, wherein.

(10) DESCRIPTION OF THE PREFERRED EMBODIMENTS

Figure 1:
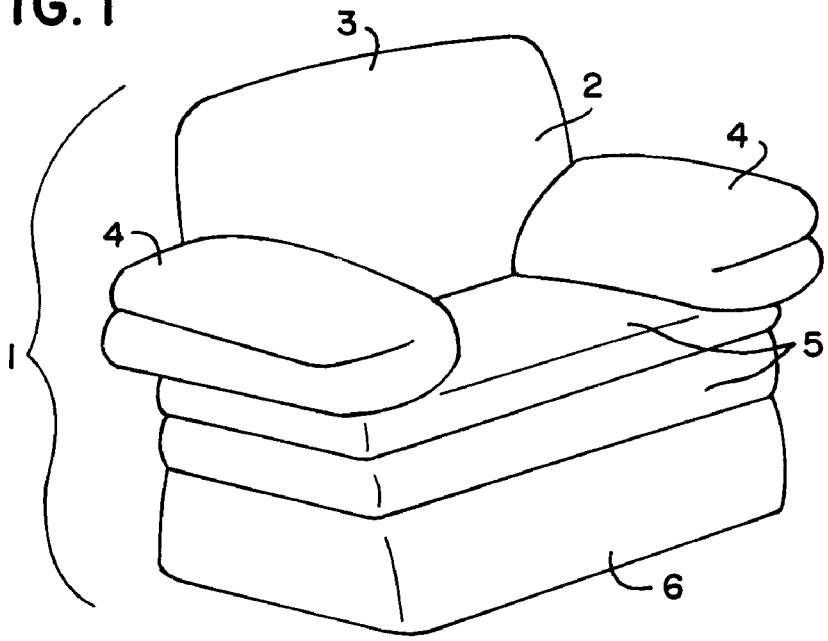
FIG. 1 shows a perspective view of an upholstered chair made of a frame and cover.

It should be understood that the seat member of the present invention means a variety of seats including chairs, love seats and sofas. Hence, while the illustrations discussed in the preferred embodiments show a type of chair frame and chair covers; the invention is not limited to these examples. The present invention is primarily concerned with providing a modular frame and cover system the allows a decorator to change all of the upholstered fabric from a seat member by reversibly affixing a cover containing upholstered filing to a frame designed to receive this cover. Referring now to FIG. 1, a preferred embodiment is shown therein of an upholstered chair 1, having an interchangeable upholstered cover 2 with back 3, a plurality of arms 4 and a loose seat cushion 5. The lower panel 6 is referred to as a band or skirt depending on the degree of ornamentation a plain lower panel 6 is a band and a decorative lower panel 6 is a skirt. Examples of a banded or pleated lower panels 6 are shown in FIGS. 2 and 3.

Figure 2:
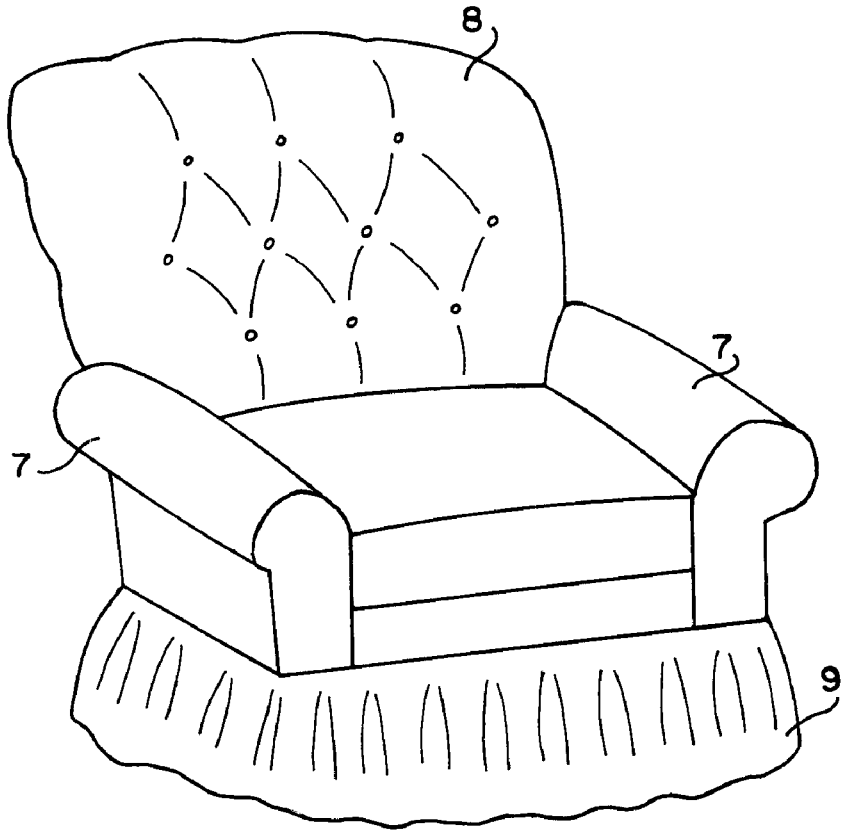
FIG. 2 shows a perspective view of another embodiment of an upholstered chair made of a frame and cover.
Figure 3:
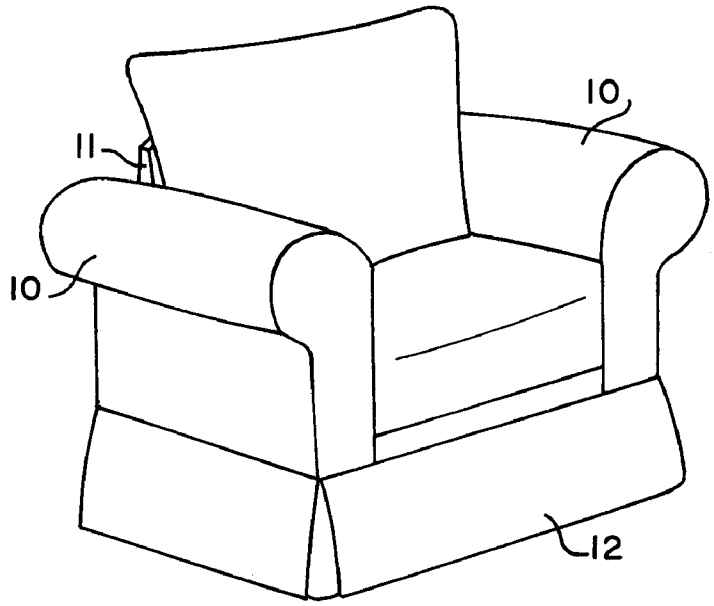
FIG. 3 shows a perspective view of another embodiment of an upholstered chair made of a frame and cover.

FIGS. 2 and 3 show alternate embodiment of the upholstered chair. In FIG. 2 a chair with a plurality of rolled arms 7, pleated back 8 and ruffled skirt 9 is shown. In FIG. 3 a chair with a plurality of rolled arms 10 straight back 11 and plain band 12 is shown. This ability to achieve such varied looks is achieved with a variety of frames and upholstered covers will be shown as follows.

Figure 4:
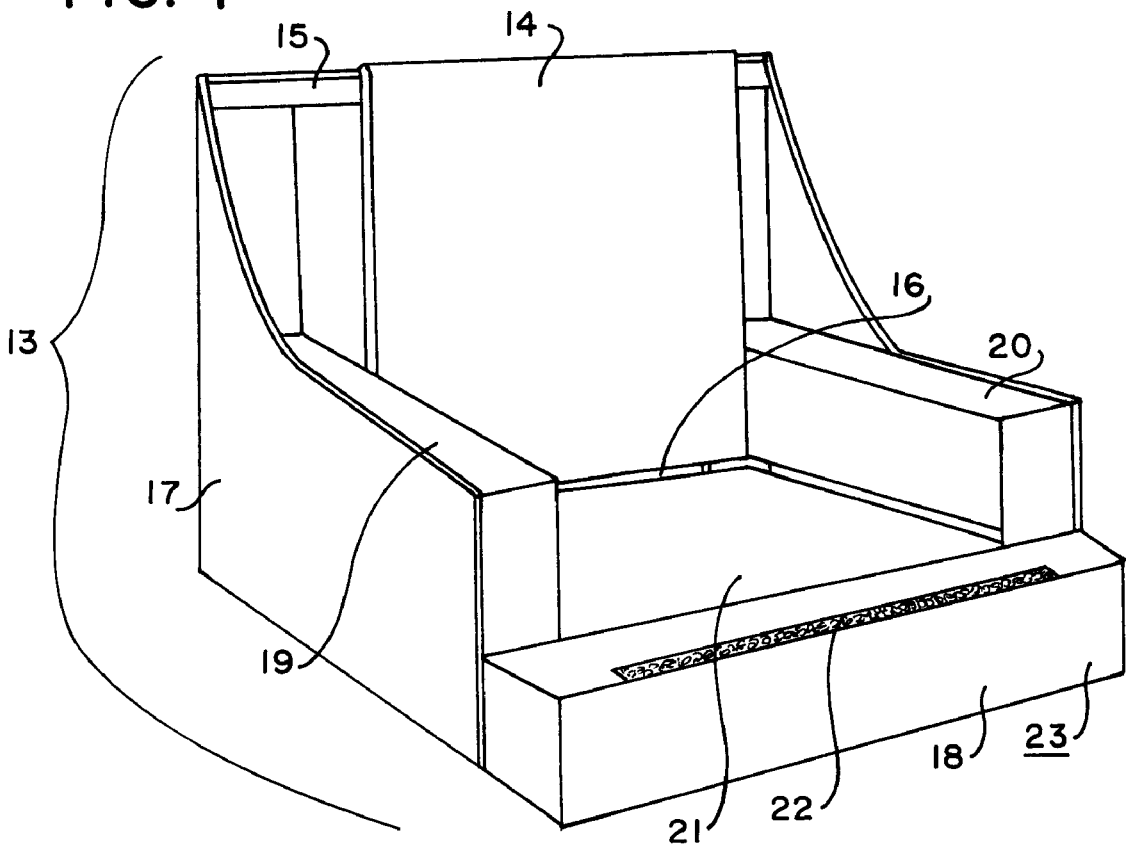
FIG. 4 shows a perspective view of the front of the frame.

Now referring to FIG. 4, frame 13 is made of a number of elements to provide support for the interchangeable upholstered cover 2. The frame 13 is made of a base frame member 18, two arm frame members 19 and 20, a back frame member 15 and a seat-decking member 21. The design of the frame depends on the desired shape of the seat member. The frame can be constructed of wood, metal or plastic as desired. Fiber filler 14 is secured to the back frame member 15 and back of seat member 16 to give support for affixed back pillow 3. The side of the frame 17 is preferably made of seat hair, but can also be made of similar material such as cardboard. The base of the frame 18 has four edge members in substantially rectangular arrangement so as to define opposite side edges and opposite ends, which are interconnected to each other at right angles. The base of the frame 18 can have foam padding attached to the front surface of the base 23 to provide cushioning. The arm structural support 19 and 20 are made of plywood or particleboard. Frame 13 also includes seat decking member 21 which is a means to support the loose pillows 5 and the weight of a person in the chair. The seat-decking member 21 is made of seat hair covered with fabric such as Doun™ or Sateen™. The fabric is attached to the seat hair by the process of sewing or gluing. The seat-decking member 21 is stapled to frame 13. An attachment means 22, which is preferably Velcro™, is attached to the seat-decking member 21. The attachment means can be Velcro™, snaps, hooks, elastic hook and grommets, or any means to provide reversible attachment, but still provide upholstered looking furniture. The Velcro™ strip in the preferred embodiment is three inches wide and runs the length of the frame 13 between the arms 19 and 20. The front of frame 23 and back of frame 15 are shown.

A decorator using these two basic components: the frame 13 and cover 2 can provide a wide variety of upholstered looks without the cost of reupholstery or purchase of a new seat member. This wide variety of upholstered looks can be achieved by providing several frame styles. The frame 13 can be a sofa or a love seat, but more specifically the frame 13 can be manufactures to provide a low or high back and rolled or square arms. Additionally, the width of the seat member can be varied according to the manufacture of the frame 13. The other component used to provide this wide variety of reupholstered looks is the cover 2. The cover 2 can be shaped with upholstery filler to have round arms, puffed arms, flat arms, and pad over arms and welted arms. The upholstery fillers can include: cotton, pillows, foam, blown fiber, bagged fiber, polyfoam or Kodel, but any suitable filler is included within the scope of this invention. The back 3 can be: flat with a detached pillow, filled with an attached pillow, pleated, gathered, welted, segmented or button punched or any other upholstery style. Additionally, the lower front panel 6 can be a skirt 10 or a band 12. The skirt 10 is generally decorative and falls from the frame 13 to the floor. The skirt 10 can be pleated, gathered or ruffled. A band 12 can be plain, separated or indented with welts. Other skirts or bands, however, could be used.

Figure 5:
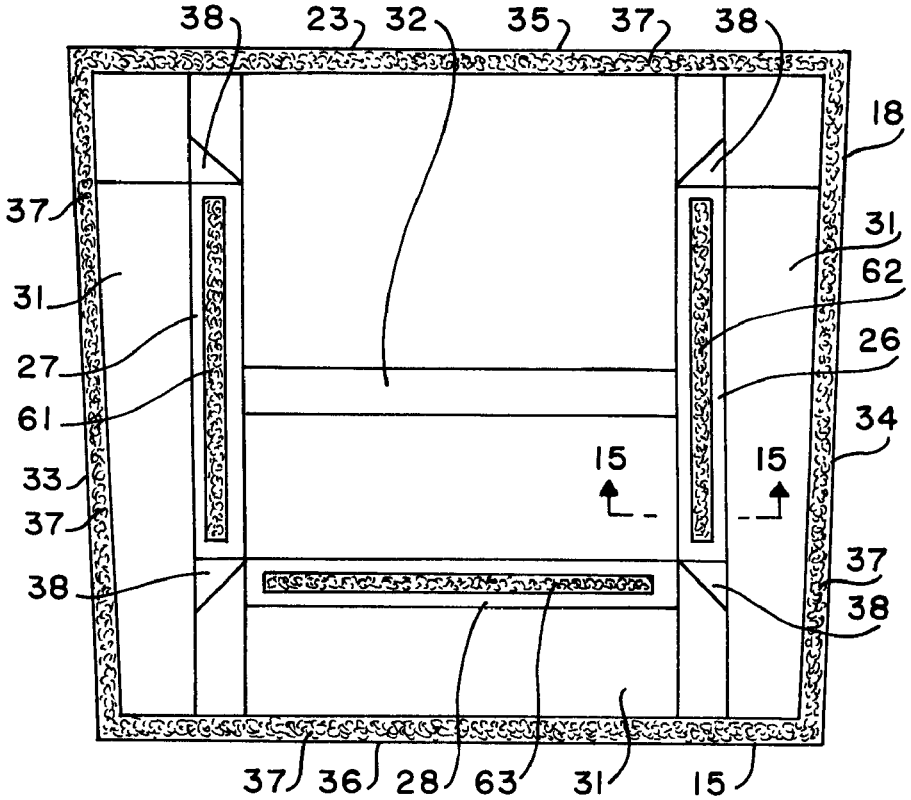
FIG. 5 shows a plan view of the bottom of the frame.

Now referring to FIG. 5 the bottom of the base of the frame 18 is shown having arm pull strip 26 and 27. The arm pull strips 26 and 27 are attached to the inside surface of the front of the frame 23 and the inside surface of the back of the frame 15. Back pull strip 28 is attached to the arm pull strips 26 and 27. In the preferred embodiment the arm pull strips 26 and 27 are about 26 and 9/16 inches in length and 1 and ¼ inches in width and the back arm strip is about 28 and ⅝ inches in length and 1 and ¼ inches in width. The arm pull strips 26, 27 and 28 have attachment means 62, 61 and 63 affixed thereto. These attachment means may be a single large strip or a plurality of smaller strips. The function of arm pull strips 26, 27 and 28 is to provide a means affix the flaps located on the cover 2 so to secure the cover 2 to the frame 13.

Again referring to FIG. 5 cross rail 32 is provided for support. Cross-rail 32 is attached to arm pull strips 26 and 27. Cross rail strip 32, in the preferred embodiment, are about 1-¾ inches in width and about 25 inches in length.

Additionally, FIG. 5 shows attachment member side rails 33 and 34 and front rail strip 35 and back rail strip 36 is provided. The function of these strips is to provide a place to affix attachment means. These attachment means may be a single large strip or a plurality of smaller strips. The function of the side rail strips is to provide a means to affix the cover 2 so to secure the cover 2 to the frame 13. In the preferred embodiment the side rails 33 and 34 are about 31 and 9/16 inches in length and about 2 and ¼ inches in width and the front rail 35 is 37 inches in length and 2 and ¼ inches in width and the back rail 36 is 34 inches in length and 2 and ¼ inches in width. Attachment means are attached to the front 35, side 33 and 34 and back rails 36 to reversibly attach the interchangeable upholstered cover 2. In the preferred embodiment, a plurality of strips 37 of Velcro are attached to the front 35, back 36 and side rails 33 and 34. Additionally, a plurality of legs 38 are shown. The legs 38 in the preferred embodiment are about two inches in height.

Figure 15:
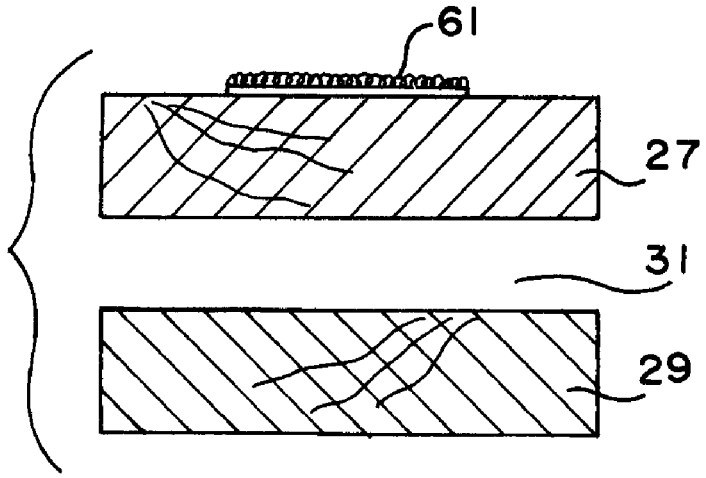
FIG. 15 shows a cross-sectional view taken in the direction of 15—15.

Now referring to FIG. 15 a cross-sectional view taken in the direction of 15—15 as shown in FIG. 5 provides a rail filer strip 29. The function of filer strips 29 are to define a plurality of spaces 31, for flaps 46, 47 and 48 to be pulled through to attach to the interchangeable upholstered cover 2, to reach the bottom side of the frame 13 and be secured therein. The rail strips 29 are located at the back and the sides of the frame 13. The side rail strips 29 are attached to the frame. The side rail strips 29 are about 26 and 9/16 inches in length and about 2 and ¼ inches in width and the back rail strip is 22 inches.

Figure 6:
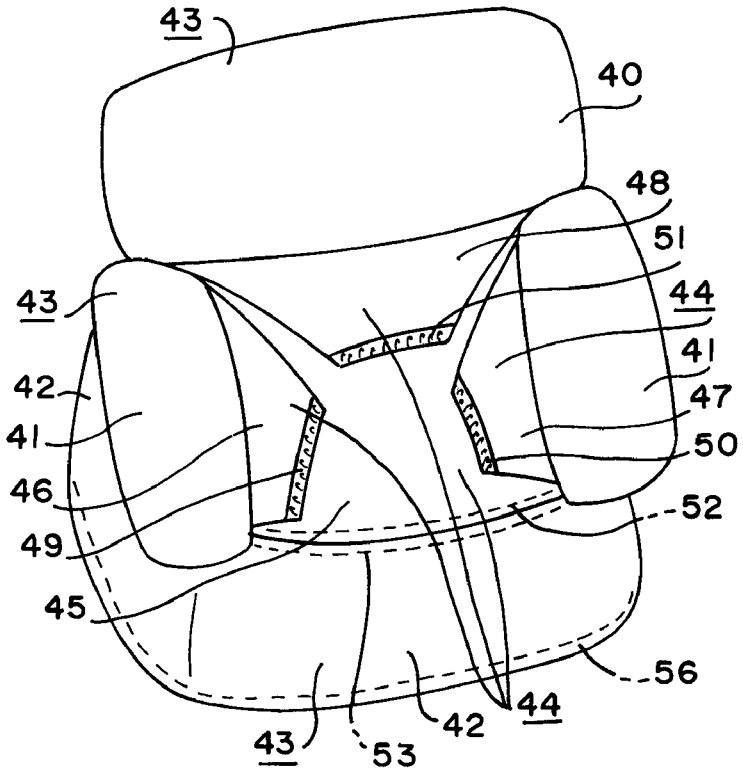
FIG. 6 shows a perspective view of the top of the cover.

Now referring to FIG. 6, an interchangeable upholstery cover 2 is shown having back 40, a plurality of arms 41, and lower portion 42. The lower portion 42 may be either a skirt or band. The back 40, arms 41 and lower portion 42 are made of an upholstery fabric and are generally given the desired shape by including filler. For example, filler can be added to a pouch or pouched located beneath the back 40, arms 41 and lower portion 42. The back 40, arms 41 and lower portion 42 made in an upholstery fabric are referred to as the outer surface 43.

Again referring to FIG. 6 the interchangeable upholstery cover 2 is shown having an inner surface 44. The inner surface 44 is made of a strong lining fabric such as Doun™ or Sateen™. The inner surface 44 has a first area shaped substantially like a seat 45. In the preferred embodiment an attachment means 52 is located on seat 45. This attachment means 52 is preferably a strip of Velcro™ of 23 inches in length and 3 in width. The function of attachment means 52 is to attach the cover 2 to the frame 13. In an alternative embodiment the attachment means 53 is located on the inside edge of the outer cover 43. The function of attachment means 53 is to attach the cover 2 to the frame 13.

A second area is provided with three flaps: side arm flaps 46 and 47 and back flap 48, projecting downwardly from the seat area 45. Attachment means are located on the ends of flaps 49, 50 and 51. Flaps 46, 47 and 48 are of sufficient length to be in a reciprocal relationship with attachment means on the bottom of the frame 13. In the preferred embodiment the flaps 46 and 47 are 18 inches in length from the attachment point arms 41 to the end of the flap and flap 48 is 18 inches in length from the attachment point under back 40 of the outer cover 43. In the preferred embodiment the attachment means are Velcro™ strips about 1 and ½ inches in width. The inner surface 44 is attached to the outer surface 43 by conventional sewing techniques.

Figure 7:
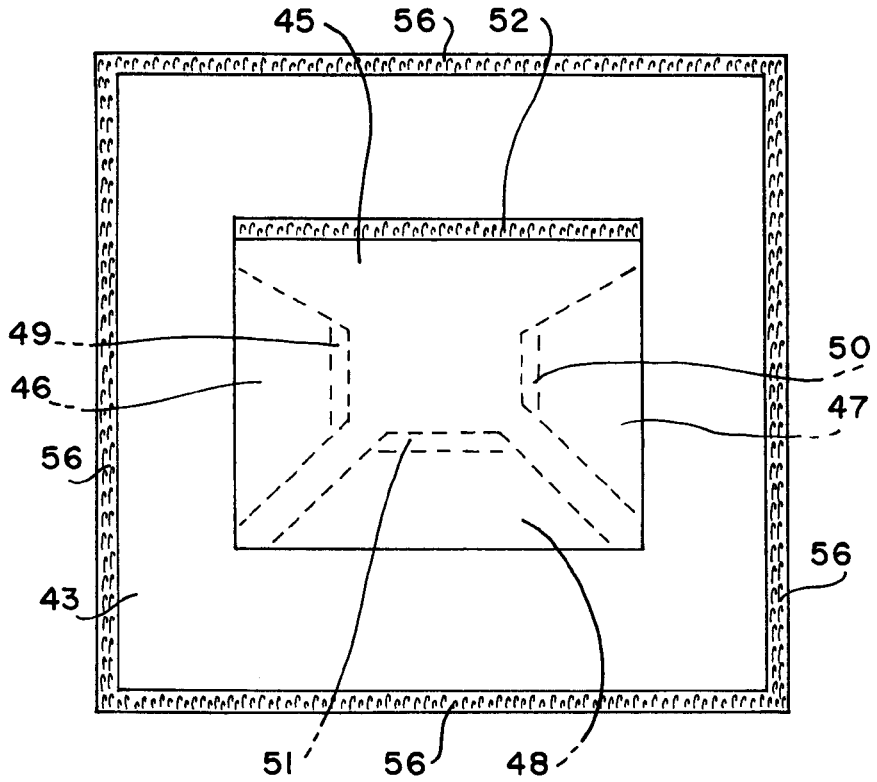
FIG. 7 shows a plan view of the bottom of the cover.

Now referring to FIG. 7 a bottom view of the inside cover 2 is provided. An attachment means 52 is positioned to contact attachment means 22 on frame 13. The attachment means 52 of the cover 2 is thus, in a reciprocal relationship with the attachment means 22 on the frame 13. In the preferred embodiment the attachment is a strip of Velcro™. Additionally, a plurality of attachment means 56 are located at the bottom inside edge of the outer surface 42 of the cover 2. In the preferred embodiment the attachment means 56 are Velcro™ strips that are about two inches in width and about 21½ inches in length. In an alternative embodiment the Velcro™ strips ran the length of the bottom inside edge of the outer surface 42 of the cover 2. Attachment means 56 are positioned to contact attachment means 37 on the frame 13. The attachment means 56 of the cover are in a reciprocal relationship with the attachment means 37 on frame 13.

Now again referring to FIG. 7 the inner surface 44 is shown having side arm flaps 46 and 47 and back flap 48, projecting downwardly from the seat area 45. Attachment means are located on the ends of flaps 49, 50 and 51. Flaps 46, 47 and 48 are of sufficient length to be in a reciprocal relationship with attachment means on the bottom of the frame 13.

Figure 8:
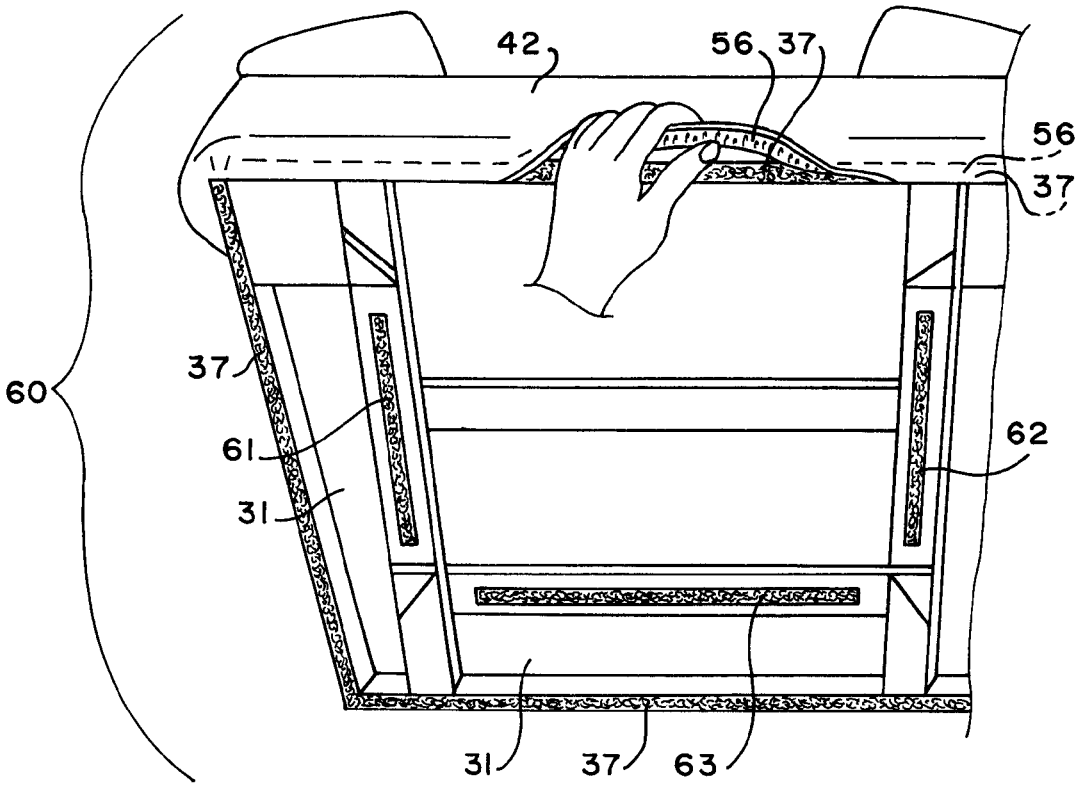
FIG. 8 shows a perspective view of the bottom of a modular unit showing the manner in which the cover is reversibly secured to the frame.

Now referring to FIG. 8 the process in which the interchangeable upholstery cover 2 is attached to frame 13 is shown. The interchangeable upholstery cover 2 is placed over frame 13 to form the modular unit 60. The modular unit 60 is defined as the cover reversibly attached to the frame without loose seat cushion 5. The cover 2 is grasped securely and pulled completely over the frame 13. Now again referring to FIG. 8, the modular unit 60 is turned on it back. The attachment means 37 on the front rail 35 is attached to the attachment means 56 on the inside of lower portion 42 of the outer cover 43. The attachment means 56 of the cover is in a reciprocal relationship with the attachment means 37 on the front rail 35.

Figure 9:
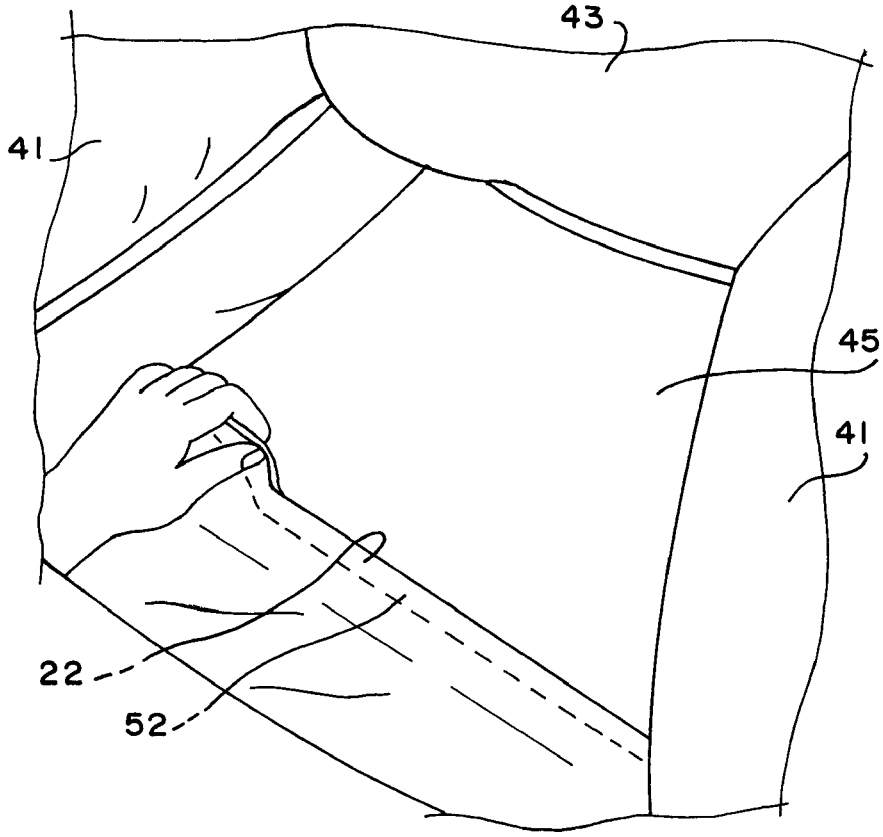
FIG. 9 shows an enlarged fragmentary view of the manner in which the attachment means on the cover is attached to the attachment means on the seat decking.

Now referring to FIG. 9, the modular unit 60 is pulled to an upright position and the attachment means 22 on the frame 13 is attached to the attachment means 52 is located on seat 45. This attachment means 52 is preferably a strip of Velcro™. The function of attachment means 52 is to attach the cover 2 to the frame 13. In an alternative embodiment the attachment means 53 is located on the inside edge of the outer cover 43. The function of attachment means 53 is to attach the cover 2 to the frame 13.

Figure 10:
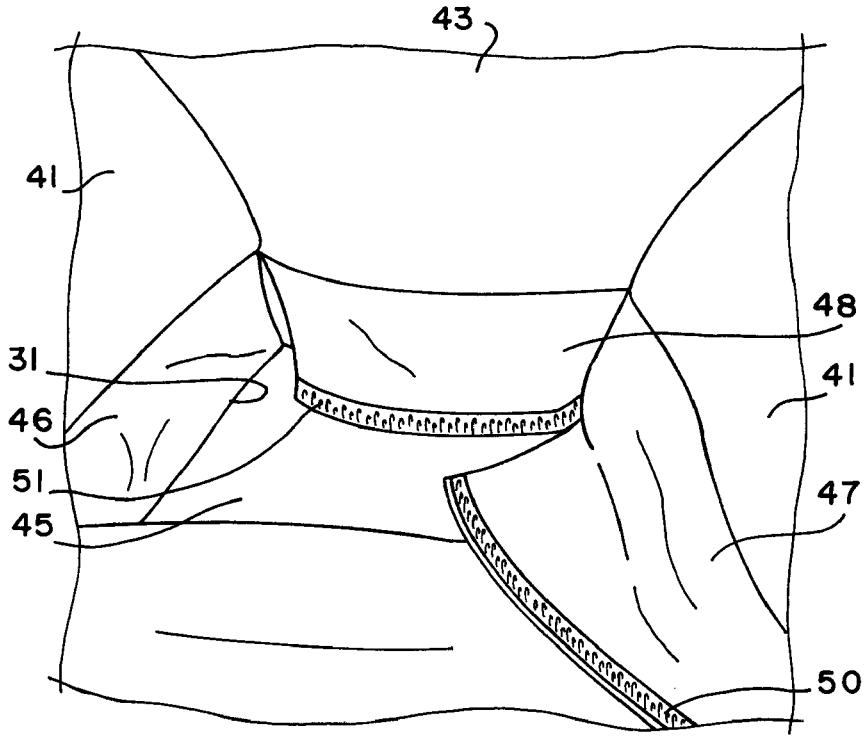
FIG. 10 shows an enlarged fragmentary view of the manner in which the flaps go through the defined spaces.
Figure 11:
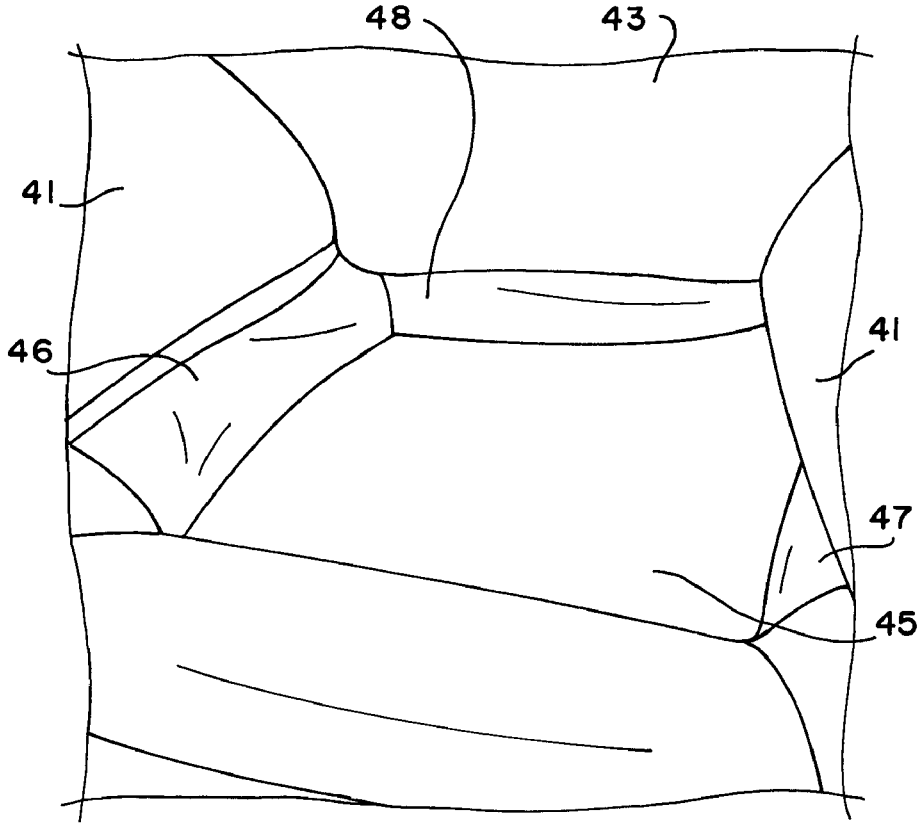
FIG. 11 shows the flaps inserted into the defined spaces.
Figure 16:
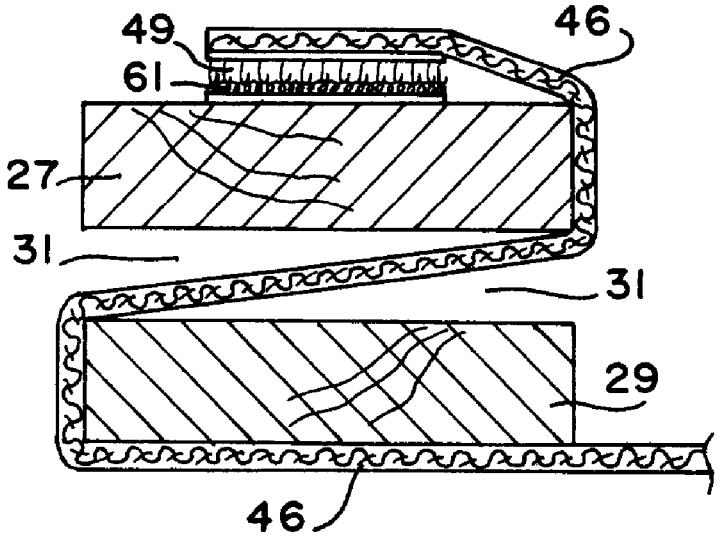
FIG. 16 shows a cross-sectional view of the flaps attached to the frame.

Now referring to FIGS. 10, 11 and 16 the side arm flaps 46 and 47 and back arm flap 48 are grasped and pulled tightly to secure the upholstered cover 2 to the frame 13. The flaps 46, 47 and 48 are slid through spaces 31. Space 31 is provided by the area between filler strip 29 and arm pull strip 27. In FIG. 11 the flaps 46, 47 and 48 are pulled through spaces 31 to leave the seat deck 45.

Figure 12:
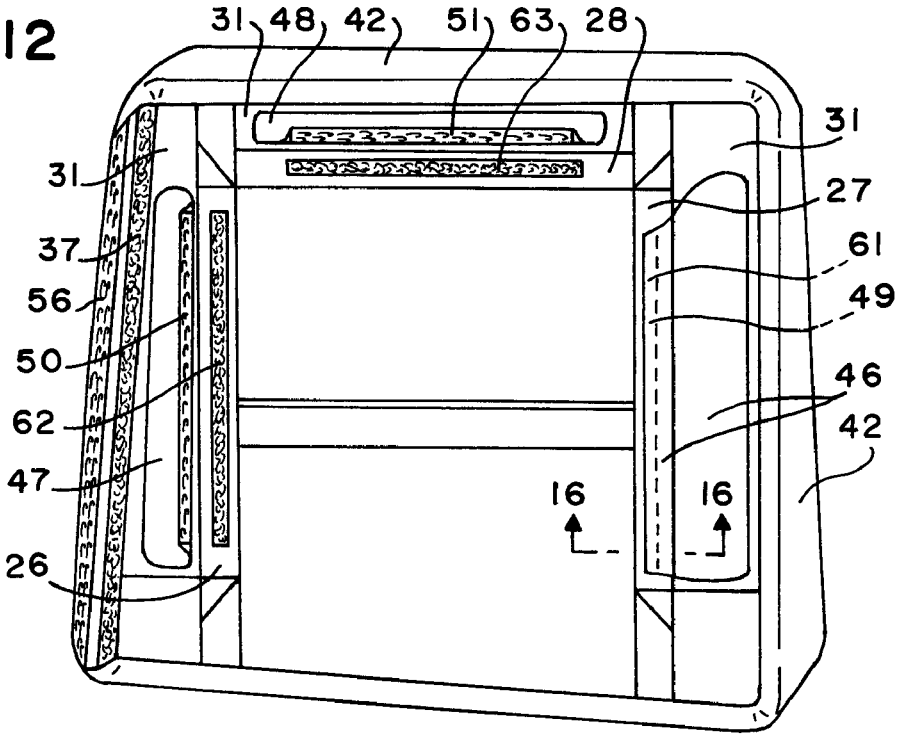
FIG. 12 shows a perspective view of the bottom of the frame resting on its backside showing the manner in which the cover is reversibly secured to the frame.

Now referring to FIG. 12 the bottom of the frame 13 is shown wherein the flaps 46, 47 and 48 are attached to attachment means on the bottom of the frame 13 to reversibly secure the cover 2. The attachment means 49 on side flap 46 is attached to attachment means 61 on arm pull strip 27. Similarly, the attachment means 50 on side flap 47 is attached to attachment means 62 on arm pull strip 28. Finally, attachment means 51 on back flap 48 is attached to attachment means 63 on back pull strip 28. Next, the plurality of attachment means 56 located on the bottom of the inside edge 53 of the cover 2 are attached to a plurality of attachment means 37 located on the sides rails 33 and 34 and back rail 37. The attachment means on the cover, is thus, in a reciprocal relationship with the attachment means on the frame 13. The upholstered cover 2 is now securely attached to the frame 13 and can be flipped with the bottom side of frame 13 on the floor.

Figure 13:
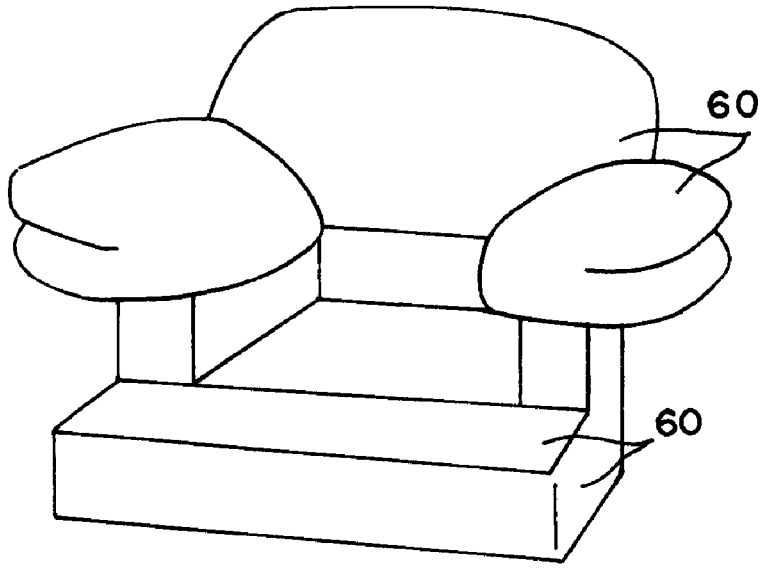
FIG. 13 shows a perspective view of an upholstered chair made according to the present invention without a loose seat cushion.
Figure 14:
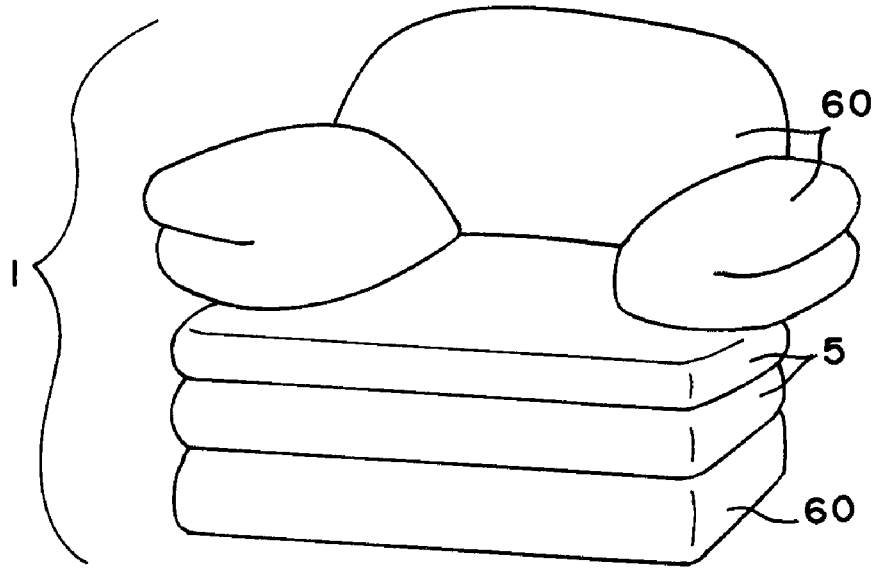
FIG. 14 shows a perspective view of an upholstered chair made according to the present invention with the loose seat cushion.

Now referring to FIGS. 13 and 14 the upholstered cover 2 is shown as securely attached to the frame 13 to form modular unit 60. In FIG. 13 the loose seat cushion 5 is placed on to fabric over seat decking 21. This process to change an upholstered cover requires approximately ten minutes of time to complete and very little skill or training the significance being that an ordinary consumer could reupholster his or her furniture with significantly decrease cost and in very short period of time as compared with traditional reupholstery means. This savings in cost would provide ordinary consumers with the ability to redecorate, with stylish upholstered furniture, an object heretofore not known.

While we have illustrated and described several embodiments of this invention, it will be understood that these are by way of illustration and the various changes may be contemplated within the scope of the following claims.

We claim:

1. A seat member to support a human body comprising a frame and a reversibly attachable cover, said frame comprising a base frame member, two arm frame members, a back frame member and a seat decking member, said base frame member having a bottom surface with means to attach said reversibly attachable cover and said seat decking member having a means to attach said reversibly attachable cover; said reversibly attachable cover consisting essentially of an inner surface and an outer surface, said inner surface having a first area shaped substantially like a seat, said area shaped substantially like a seat having means to attach to said seat decking member and a second area with flaps projecting downwardly from said area shaped substantially like a seat, said flaps having means to attach to said bottom surface of said base frame member;

and said outer surface of said reversibly attachable cover, forming the shape of said seat member, and said outer surface having a plurality of means on a bottom inside edge of said outer surface to attach said outer surface to said bottom surface of said base frame member.

2. The seat member of claim 1 wherein said frame is made of wood.

3. The seat member of claim 1 wherein said seat member is selected from the group consisting of: a chair, love seat or sofa.

4. A seat member to support a human body comprising a frame and a reversibly attachable cover, said frame comprising a base frame member, two arm frame members, a back frame member and a seat decking member, said base frame member having a bottom surface with means to attach said reversibly attachable cover and said seat decking member having a means to attach said reversibly attachable cover; said reversibly attachable cover consisting essentially of an inner surface and an outer surface, said inner surface having a first area shaped substantially like a seat and a second area with flaps projecting downwardly from said area shaped substantially like a seat, said flaps having means to attach to said bottom surface of said base frame member;

and said outer surface of said reversibly attachable cover, forming the shape of said seat member, and said outer surface having a plurality of means on a bottom inside edge to attach said outer surface to said bottom surface of said base frame member and a means on a inside edge of a seat portion of said outer surface of said reversibly attached cover to attach to said frame.

5. The seat member of claim 4 wherein said frame is made of wood.

6. The seat member of claim 4 wherein said seat member is selected from the group consisting of: a chair, love seat or sofa.

* * * * *